US006925670B2

(12) United States Patent
Torrez

(10) Patent No.: US 6,925,670 B2
(45) Date of Patent: Aug. 9, 2005

(54) FULL-BODY MATTRESS WITH INCLINED PORTION AND COVERING FOR SAME

(76) Inventor: Barbara M. Torrez, 10120 W. Exposition Dr., Lakewood, CO (US) 80226

( * ) Notice: Subject to any disclaimer, the term of this patent is extended or adjusted under 35 U.S.C. 154(b) by 57 days.

(21) Appl. No.: 10/373,852

(22) Filed: Feb. 27, 2003

(65) Prior Publication Data

US 2004/0168257 A1 Sep. 2, 2004

(51) Int. Cl.[7] ..... A47C 27/00
(52) U.S. Cl. ..... 5/731; 5/732
(58) Field of Search ..... 5/731, 732, 690, 5/655

(56) References Cited

U.S. PATENT DOCUMENTS

| | | | | | |
|---|---|---|---|---|---|
| 254,759 | A | * | 3/1882 | Young | 5/731 |
| 433,905 | A | * | 8/1890 | Muller | 5/731 |
| 1,382,531 | A | | 7/1921 | Newborn | |
| 1,432,875 | A | | 10/1922 | Lavagetto | |
| 2,182,861 | A | | 12/1939 | Albert | |
| 3,009,172 | A | | 11/1961 | Eidam | |
| 3,389,411 | A | * | 6/1968 | Emery | 5/690 |
| D220,823 | S | | 5/1971 | Howe et al. | |
| 3,648,308 | A | | 3/1972 | Greenawalt | |
| 4,193,150 | A | | 3/1980 | Vineberg | |
| 4,935,978 | A | * | 6/1990 | Luchonok et al. | |
| 5,448,790 | A | * | 9/1995 | Saro et al. | 5/732 |
| 5,637,730 | A | * | 6/1997 | Murthy et al. | 5/732 |
| 5,771,515 | A | * | 6/1998 | Carr | 5/690 |

FOREIGN PATENT DOCUMENTS

| | | |
|---|---|---|
| FR | 2616641 | 12/1988 |
| JP | 7-246134 | 7/1995 |

* cited by examiner

*Primary Examiner*—Alexander Grosz
(74) *Attorney, Agent, or Firm*—Edwin H. Crabtree; Ramon L. Pizarro

(57) ABSTRACT

A full-body mattress for the prevention of conditions which may have a negative impact on health and for the improvement of the health and comfort of a user. The full-body mattress has a first end with a first height, a second end opposite the first end with a second height, a top surface disposed between the first end and the second end, with approximately one half of the top surface being horizontal and planar, and a bottom surface opposite the top surface. The first height is less than the second height, only a portion of the top surface is inclined at an angle, the angle is located in a plane defined by a length and a height of the full-body mattress, the angle is between about 30 degrees, and the bottom surface is not parallel with the inclined portion of the top surface. Also, in combination, a full-body mattress as described above, and a full-body mattress covering adapted to fit the full-body mattress removable bumpers are attached to the top surface of the full body, integral, and unitary mattress.

1 Claim, 4 Drawing Sheets

FULL-BODY MATTRESS WITH INCLINED PORTION AND COVERING FOR SAME

BACKGROUND OF THE INVENTION

1. Field of the Invention

The present invention relates to a full-body mattress with an inclined portion for the prevention of conditions which may have a negative impact on health and for the improvement of the health and comfort of a user. Also, the present invention relates to the full-body mattress in combination with a full-body mattress covering adapted to fit the full-body mattress.

2. Description of the Related Art

In order to prevent or treat a variety of medical problems, doctors and medical professionals often recommend sleeping with the head and/or torso elevated at a certain height or sleeping on an inclined surface at a certain angle. This is particularly important in the care of an infant or incapacitated person who might be susceptible to a choking hazard in the form of regurgitated matter.

One solution for achieving the desired elevation or angle of inclination involves placing a stack of bricks or blocks under one end of a bed. Also, parents of infants are told to place rolled-up towels or blankets under the crib mattress supporting the infant. These solutions are not permanent, are often difficult to implement, and do not provide a uniform sleeping surface. Furthermore, the use of bricks, blocks, towels, blankets and the like do not lend themselves to achieving the precise height or angle recommended by doctors and medical professionals.

Another proposed solution for achieving the desired elevation or angle of inclination is a bed having a mechanical or electrically operated device for raising one end of the bed. These beds are often expensive. Furthermore, in the case of an infant or incapacitated person, such beds cannot be operated without the assistance of a nurse, parent, or caretaker.

A variety of devices have been proposed for inclined mattresses, pillows, cushions and the like. U.S. Pat. No. 433,905, issued Aug. 5, 1890 to Muller, describes a mattress made in sections, one of the sections being inclined. U.S. Pat. No. 1,382,531, issued Jun. 21, 1921 to Newborn, describes a pneumatic inclined mattress. U.S. Pat. No. 1,432,875, issued Oct. 24, 1922 to Lavagetto, describes an inclined mattress with an upwardly extending rolled rim. U.S. Pat. No. 2,182,861, issued Dec. 12, 1939 to Albert, describes an adjustable treatment pad made in sections. No dimensions or specifications are given for the angle of the incline of the Muller, Newborn, Lavagetto and Albert devices, or for the difference in height of the devices between the lowest and highest points.

U.S. Pat. No. 3,009,172, issued Nov. 21, 1961 to Eidam, describes a head suspending pillow. U.S. Des. Pat. No. 220,823, issued May 25, 1971 to Howe et al., describes a contoured pillow. The Eidam and Howe devices are pillows, not full-body mattresses, and no dimensions or specifications are given for the angle of the incline or the difference in height of the pillow between the lowest and highest points.

U.S. Pat. No. 3,648,308, issued Mar. 14, 1972 to Greenawalt, describes an elevated traction pillow. The Greenawalt device is a pillow, not a full-body mattress. The depth of the Greenawalt pillow "can vary from about 6 inches to about 26 inches although a slope of 45° is quite unusual and is generally not utilized herein" (col. 2, lines 37–39). In other words, the difference in height of the incline between the lowest and highest points is between 6" and 26".

U.S. Pat. No. 4,193,150, issued Mar. 18, 1980 to Vineberg, describes an elevated mattress. Despite the name, the Vineberg device is a wedge-shaped device used on top of a conventional mattress. The Vineberg device is not a full-body mattress. The Vineberg device has a thickness from about 6⅛" down to about 5⅞" at the head end and, at the foot, is thick enough to provide a perceptible step up from the normal mattress, for example, in the neighborhood of one-half inch (col. 1, lines 35–38). In other words, the difference in height of the incline between the lowest and highest points is between 5⅜" and 5⅝".

U.S. Des. Pat. No. 271,647, issued Dec. 6, 1983 to McLeod, describes a body torso support pad. The McLeod design is for a support pad, not a full-body mattress, and no dimensions or specifications are given for the angle of the incline or the difference in height of the support pad between the lowest and highest points.

U.S. Pat. No. 4,665,573, issued May 19, 1987 to Fiore, describes a contoured body support structure. Like the Vineberg device, the Fiore device is used on top of a conventional mattress and is not a full-body mattress. The Fiore device is directed to aligning the spine of the person using the device in a horizontal direction. The person using the Fiore device is not resting on an incline, rather the Fiore device supports the spine and body at various locations. The thickness of the Fiore device varies between a minimum of 1" at the foot end and a maximum of 4" at the lumbar portion. Further, no dimensions or specifications are given for the angle of the inclined portions of the Fiore device.

U.S. Pat. No. 4,685,163, issued Aug. 11, 1987 to Quillen et al., describes a recliner for medical convalescence. Like the Vineberg and Fiore devices, the Quillen device is used on top of a conventional mattress and is not a full-body mattress. The back and neck support of the Quillen recliner extends upwardly at an angle between 30 degrees and 45 degrees; however, this angle does not extend the full length of the recliner.

French Patent FR 2,616,641, published Dec. 23, 1988 to Broc, describes a convertible mattress. The prismatic blocks 2, 3 of the Broc mattress, when rotated about one another (FIG. 2), are disposed at an angle of 30 degrees; however, this angle does not extend the full length of the mattress. Nothing in the disclosure of Broc teaches or suggests changing the angle. Further, no disclosure is made as to the difference in the vertical height of the ends of the device.

U.S. Pat. No. 4,930,171, issued Jun. 5, 1990 to Frantz, describes a contour retaining support cushion. The Frantz device is designed for use with a person in a seated position and is not a full-body mattress for a person lying down.

U.S. Pat. No. 4,987,625, issued Jan. 29, 1991 to Edelson, describes an adjustable personal support apparatus. The Edelson device does not support the full length of the body of a user and is not a full-body mattress. Also, no dimensions or specifications are given for the angle of the inclined portion or the difference in height of the Edelson device between the lowest and highest points.

Japanese Patent No. JP 7-246134, published Jul. 12, 1995 to Girse, describes a support cushion for stabilizing adults or small children when lying on the back, the stomach and the side. The Girse device is a support cushion and not a full-body mattress.

U.S. Pat. No. 5,800,368, issued Sep. 1, 1998 to Klingemann et al., describes a sleeping device for infants having trachea malacia and/or gastro-intestinal reflux. Klingemann is specifically directed to a device with an upper wall 14 disposed at an angle of forty-five degrees and the vertical height varies from 3" on the low side to 20" on the high side. Nothing in the disclosure of Klingemann teaches or suggests changing the angle or varying the vertical height of the ends of the device. In other words, the difference in height of the incline between the lowest and highest points is 17".

U.S. Patent Application Publication No. 2001/0042269 A1, published Nov. 22, 2001 to Mann, and U.S. Pat. No. 6,421,855, issued Jul. 23, 2002 to Mann, describe an infant bed having a tiltable sleeping surface and method of treating positional plagiocephaly, which is the deformation of the head of an infant. The tiltable sleeping surface of Mann tilts from side to side and not along the length of the bed. Also, the bottom surface of the Mann mattress is parallel to the top surface.

U.S. Pat. No. 6,334,442 B1, issued Jan. 1, 2002 to Altamura, describes a recumbent therapeutic support. The incline of one portion of the Altamura device is within a range of 5° and 20°; however, this angle does not extend the full length of the device. Also, no dimensions or specifications are given for the difference in height of the Altamura device between the lowest and highest points.

U.S. Patent Application Publication No. US 2002/0032928 A1, published Mar. 21, 2002 to Hynansky, describes a bed assembly with an insert for invalids. The mattress disclosed in Hynansky is conventional except for a hole therein.

U.S. Pat. No. 6,371,894 B1, issued Apr. 16, 2002 to Hill, describes a medical device for physical therapy treatment. The Hill device is designed for use with the legs of a physical therapy treatment and is not intended for use as a full-body mattress. Although an angle is contemplated by the disclosure, the angle is not disclosed and is intended to "provide an appropriate range of motion for a patient's legs when performing certain therapeutic exercises with the resilient article 11" (col. 8, lines 12–15).

U.S. Pat. No. 6,381,785 B1, issued May 7, 2002 to Mancera Browne et al., describes a dismountable and adjustable fastening device for laying down pediatric patients in an inclined position. The Mancera Browne device is directed to a device for supporting an infant on an incline and not the mattress supporting the infant. Furthermore, no dimensions or specifications are given for the angle of the inline or the difference in height of the incline between the lowest and highest points.

U.S. Patent Application Publication No. 2002/0116764 A1, published Aug. 29, 2002 to Plummer et al., describes a bed with adjustable positions. No dimensions or specifications are given for the angle of the incline of the Plummer pneumatic bag subassembly 424 or the difference in height of the pneumatic bag subassembly 424 between the lowest and highest points.

None of the above inventions and patents, taken either singly or in combination, is seen to describe the instant invention as claimed. Thus an inclined mattress solving the aforementioned problems is desired.

SUMMARY OF THE INVENTION

The present invention is a full-body mattress for the prevention of conditions which may have a negative impact on health and for the improvement of the health and comfort of a user. The full-body mattress has a first end with a first height, a second end opposite the first end with a second height, a top surface disposed between the first end and the second end, and a bottom surface opposite the top surface. The first height is less than the second height. At least a portion of the top surface is inclined at an angle, the angle being located in a plane defined by a length and a height of the full-body mattress. The angle is between about 1 degree and about 44 degrees. The bottom surface is not parallel with the inclined portion of the top surface. The present invention includes a full-body mattress covering adapted to fit the full-body mattress.

Accordingly, it is a principal object of the invention to provide a full-body mattress for the prevention of conditions which may have a negative impact on health and for the improvement of the health and comfort of a user.

It is another object of the invention to provide a full-body mattress with a portion of a top surface at an incline.

It is a further object of the invention to provide a full-body mattress with an incline at an angle between about 1 degree and about 44 degrees, where the angle is located in a plane defined by a length and a height of the full-body mattress.

It is a further object of the invention to provide a full-body mattress with where one end is higher than the other by between about 5.08 cm, (2") and about 15.24 cm (6").

Still another object of the invention is to provide a full-body mattress with a portion of a top surface at an incline in combination with a full-body mattress covering adapted to fit the full-body mattress.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

DETAILED DESCRIPTION OF THE PREFERRED EMBODIMENTS

The present invention is directed to a full-body mattress 10 for the prevention of conditions which may have a negative impact on health and for the improvement of the health and comfort of a user. The present invention is also directed to, in combination, a full-body mattress 10 and a full-body mattress covering 40 adapted to fit the full-body mattress 10.

The full-body mattress 10 of the present invention is particularly useful in preventing an infant or incapacitated person from choking on regurgitated matter, particularly during sleep. Besides infants, examples of an incapacitated person include a bed-ridden person, an elderly person, a handicapped person, an injured person, an unconscious person, a person prone to seizure, an intoxicated person, etc.

Also, the full-body mattress is useful in treating and/or preventing acid reflux, allergies, asthma, colds, congestion, ear infections, gastroesophageal reflux disease (GERD), heartburn, high blood pressure (hypertension), hypovolemia, insomnia, nocturnal diuresis, orthostatic hypotension, postnasal drip, pressure ulcers, seizures, sleep discomfort, sleep disorders, snoring, upper respiratory infections, vertigo, and the like.

Figure 1:
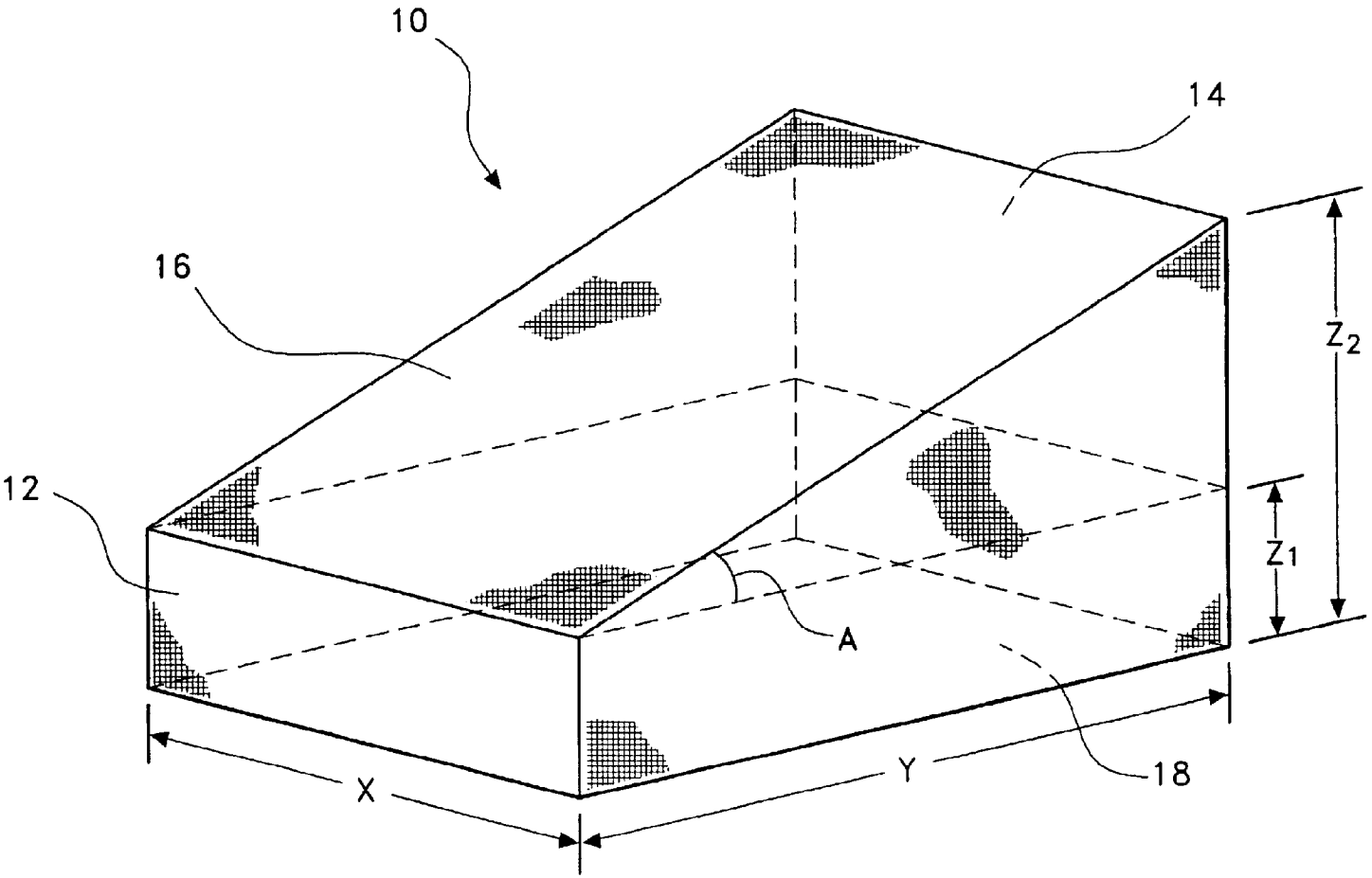
FIG. 1 is a perspective view of a full-body mattress according to the present invention.

In a first embodiment, as shown in FIG. 1, the full-body mattress 10 comprises a first end 12 with a first height $Z_1$, a second end 14, disposed opposite the first end 12, with a second height $Z_2$, a top surface 16 disposed between the first end 12 and the second end 14, and a bottom surface 18 disposed opposite the top surface 16. The first height $Z_1$ is less than the second height $Z_2$. At least a portion of the top surface 16 is inclined at an angle A, the angle A being located in a plane defined by a length Y and a height $Z_1$ or $Z_2$ of the full-body mattress 10. The angle A is between about 1 degree and about 44 degrees. The bottom surface 18 is not parallel with the inclined portion of the top surface 16. In using the term "full-body," the present inventor intends to describe a mattress suitable for supporting the full length of the body of a human user, whether the user is an infant, child or adult.

The full-body mattress 10 may be made from the same materials and in the same manner as any type of mattress. For example, the full-body mattress 10 may be made from the same materials as a conventional mattress, a futon mattress, an air bed, an inflatable mattress, a foam rubber mattress, a viscoelastic foam mattress, and the like.

The bottom surface of the full-body mattress 10 may be provided in any suitable size or shape. For example, the bottom surface of the full-body mattress 10 may be adapted to fit a king, queen, full, twin, crib or bassinette size bed frame. The bottom of the full-body mattress 10 may be rectangular, oval, or any other suitable shape which is adapted to fit a corresponding bed frame.

It will be noted the drawings of the present application are a diagrammatic depiction of the full-body mattress 10. As such, the full-body mattress 10 is shown with sharp corners and edges; however, it is to be understood that the shape of the full-body mattress 10 of the present invention may have slightly rounded corners and edges. Similarly, although the surface of the full-body mattress 10 is shown as completely flat, it is to be understood that the surface of the mattress may have similar surface features as compared to conventional mattresses, such as stitching or a textured surface. Furthermore, variations of the surface of the full-body mattress 10 are contemplated, such as use of an egg-crate type surface or similar surface feature.

There are several useful modifications to the basic full-body mattress 10 of the present invention. The full-body mattress 10 of the present invention may be used in lieu of a conventional mattress, or the full-body mattress 10 of the present invention may be used on top of an existing conventional mattress. In particular, for a crib or bassinette size full-body mattress, the full-body mattress 10 of the present invention may be used as an insert.

Also, straps may be attached to the full-body mattress 10 to prevent the user from sliding, but they are not necessary. Also, for example, an infant support device such as the one disclosed in U.S. Pat. No. 6,381,785 B1, issued May 7, 2002 to Mancera Browne et al., may be used in combination with the full-body mattress 10 of the present invention.

In a second embodiment, the full-body mattress 10 includes all the features of the first embodiment, and the first height $Z_1$ is less than the second height $Z_2$ by between about 5.08 cm (2") and about 15.24 cm (6"). In other words, the head of the user of the full-body mattress 10 is elevated by between about 5.08 cm (2") and about 15.24 cm (6").

There are numerous health advantages to elevating the head of the user. For example, elevating the head by about 15.24 cm 6") or higher is useful to treat heartburn, acid reflux, and gastroesophageal reflux disease (GERD). Also, elevating the head by between about 5.08 cm (2") and about 15.24 cm (6") is useful in treating a cold or upper respiratory infection. Specifically, this elevation helps relieve congestion and postnasal drip. Further, elevating the head as described above helps prevent allergies, asthma, ear infections, seizures, snoring, vertigo, and the like.

In the present invention, the angle A of the full-body mattress 10 is the arctangent of the difference between the first height $Z_1$ and the second height $Z_2$ divided by the length Y of the full-body mattress 10. For example, for king and queen size full-body mattresses 10 with a length Y of about 203.20 cm 80"), a difference of about 10.16 cm (4") results in an angle A of about 2.9 degrees. Alternately, a difference of about 15.24 cm (6") results in an angle A of about 4.3 degrees.

For example, for full and twin size full-body mattresses 10 with a length Y of about 190.50 cm (75"), a difference of about 10.16 cm (4") results in an angle A of about 3.1 degrees. Alternately, a difference of about 15.24 cm (6") results in an angle A of about 4.6 degrees.

For a crib size full-body mattress 10 with a length Y of about 129.54 cm (51"), a difference of about 7.62 cm (3") results in an angle A of about 3.4 degrees. Alternately, a difference of about 15.24 cm (6") results in an angle A of about 6.7 degrees.

For a bassinette size full-body mattress 10 with a length Y of about 81.28 cm (32"), a difference of about 5.08 cm (2") results in an angle A of about 3.6 degrees. Alternately, a difference of about 7.62 cm (3") results in an angle A of about 5.4 degrees. In another alternate, a difference of about 15.24 cm (6") results in an angle A of about 10.6 degrees.

In a third embodiment, the full-body mattress 10 includes all the features of the first embodiment, the first height $Z_1$ is .between about 5.08 cm (2") and about 40.64 cm (16"), and the second height $Z_2$ is between about 10.16 cm (4") and about 55.88 cm (22"). This range is appropriate for a king, queen, full, twin, crib or bassinette size full-body mattresses 10 with a difference between the first height $Z_1$ and the second height $Z_2$ of between about 5.08 cm (2") and about 15.24 cm (6"). For example, a bassinette size full-body mattress 10 may have a first height $Z_1$ of about 5.08 cm (2") and a second height $Z_2$ of about 10.16 cm (4"); whereas, a deluxe king size mattress may have a first height $Z_1$ of about 40.64 cm (16") and a second height $Z_2$ of about 55.88 cm (22"). Any combination of the first height $Z_1$ and the second height $Z_2$ may be made so long as the first height $Z_1$ is less than the second height $Z_2$.

In a fourth embodiment, the full-body mattress 10 includes all the features of the first embodiment, the first height $Z_1$ is about 17.78 cm (7"), and the second height $Z_2$ is about 27.94 cm These heights are desirable when using the full-body mattress 10 of the present invention in a king, queen, full or twin size bed frame.

For example, for a king size version of the present invention, the full-body mattress 10 may be provided with a width X of about 193.04 cm (76"), a length Y of about 203.20 cm 80"), a first height $Z_1$ of about 17.78 cm (7"), and a second height $Z_2$ of about 27.94 cm (11"). This results in an angle A of about 2.9 degrees.

For a queen size version of the present invention, the full-body mattress 10 may be provided with a width X of about 152.40 cm (60"), a length Y of about 203.20 cm (80"), a first height $Z_1$of about 17.78 cm (7"), and a second height $Z_2$ of about 27.94 cm (11"). This results in an angle A of about 2.9 degrees.

For a full size version of the present invention, the full-body mattress 10 may be provided with a width X of about 137.16 cm (54"), a length Y of about 190.50 cm (75"), a first height $Z_1$ of about 17.78 cm (7"), and a second height $Z_2$ of about 27.94 cm 11"). This results in an angle A of about 3.1 degrees.

For a twin size version of the present invention, the full-body mattress 10 may be provided with a width X of about 99.06 cm (39"), a length Y of about 190.50 cm (75"), a first height $Z_1$ of about 17.78 cm (7"), and a second height $Z_2$ of about 27.94 cm 11"). This results in an angle A of about 3.1 degrees.

In a fifth embodiment, the full-body mattress 10 includes all, the features of the first embodiment, the first height $Z_1$ is about 7.62 cm (3"), and the second height $Z_2$ is about 15.24 cm 6"). These heights are desirable when using the full-body mattress 10 of the present invention in a crib size bed frame.

For example, for a crib size version of the present invention, the full-body mattress 10 may be provided with a width X of about 68.58 cm (27"), a length Y of about 129.54 cm 51"), a first height $Z_1$ of about 7.62 cm (3"), and a second height $Z_2$ of about 15.24 cm (6"). This results in an angle A of about 3.4 degrees.

In a sixth embodiment, the full-body mattress 10 includes all the features of the first embodiment, the first height $Z_1$ is about 5.08 cm (2"), and the second height $Z_2$ is about 12.70 cm 5"). These heights are desirable when using the full-body mattress 10 of the present invention in a bassinette.

For example, for a bassinette size version of the present invention, the full-body mattress 10 may be provided with a width X of about 43.18 cm (17"), a length Y of about 81.28 cm 32"), a first height $Z_1$ of about 5.08 cm (2"), and a second height $Z_2$ of about 12.70 cm (5"). This results in an angle A of about 5.4 degrees.

In a seventh embodiment, the full-body mattress 10 includes all the features of the first embodiment, and the angle A is between about 3 degrees and about 11 degrees. This range is significant and desirable in that it includes all the desirable angles and elevations described in detail above with respect to the second, third, fourth, fifth and sixth embodiments of the present invention.

In an eighth embodiment, the full-body mattress 10 includes all the features of the first embodiment, and the angle A is between about 15 degrees and about 30 degrees.

This range is desirable in preventing an infant or incapacitated person from regurgitating during sleep and from choking on regurgitated matter during sleep. When the head of an infant or incapacitated person is raised between about 15 degrees and about 30 degrees, gravity assists the digestive process and prevents regurgitation and a potential life-threatening choking hazard to the infant or incapacitated person.

In a ninth embodiment, the full-body mattress 10 includes all the features of the first embodiment, and the angle A is about 30 degrees. An angle A of about 30 degrees is desirable in preventing an infant or incapacitated person from regurgitating during sleep and from choking on regurgitated matter during sleep. Also, an angle A of about 30 degrees during sleep is desirable in the management of high blood pressure (hypertension). In particular, the 30 degree angle A minimizes nocturnal diuresis with resultant morning hypovolemia and orthostatic hypotension. Further, the 30 degree angle A during sleep is desirable for people confined to the bed in that it helps prevent pressure ulcers.

In a tenth embodiment, the full-body mattress 10 includes all the features of the first embodiment, and the angle A is greater than 1 degree and less than 5 degrees or greater than 20 degrees and less than 30 degrees. For the reasons stated above with respect to the second, third, fourth, fifth, sixth, seventh and eighth embodiments, an angle A of greater than 1 degree and less than 5 degrees or greater than 20 degrees and less than 30 degrees is desirable.

In an eleventh embodiment, as shown in FIG. 1, the full-body mattress 10 includes all the features of the first embodiment, and all portions of the top surface 16 are inclined at the angle A. In other words, the entire body of the user of the full-body mattress 10 is inclined, because the entire top surface 16 of the full-body mattress 10 is inclined at the angle A.

It is desirable to support the full length of the body at an incline in order to prevent blockage or kinking of the airway of the user due to a sharp angle on the neck. This is particularly important for an infant or an incapacitated person which may be unable to independently adjust their sleeping position. The full length incline also prevents lower back pain that may result from a partially inclined sleeping position.

In a twelfth embodiment, the full-body mattress 10 includes all the features of the first, -seventh, and eleventh embodiments.

In a thirteenth embodiment, the full-body mattress 10 includes all the features of the first, eighth, and eleventh embodiments.

In a fourteenth embodiment, the full-body mattress 10 includes all the features of the first, ninth, and eleventh embodiments. With an angle A of 30 degrees along the entire top surface 16 of the full-body mattress 10, the difference between the first height $Z_1$ and the second height $Z_2$ would be about 117.35 cm (46.2") for a king or queen size full-body mattress, about 109.98 cm (43.3") for a full or twin size full-body mattress, about 74.68 cm (29.4") for a crib size full-body mattress, and about 46.99 cm (18.5") for a bassinette size full-body mattress.

In a fifteenth embodiment, the full-body mattress 10 includes all the features of the first, tenth, and eleventh embodiments.

Figure 2:
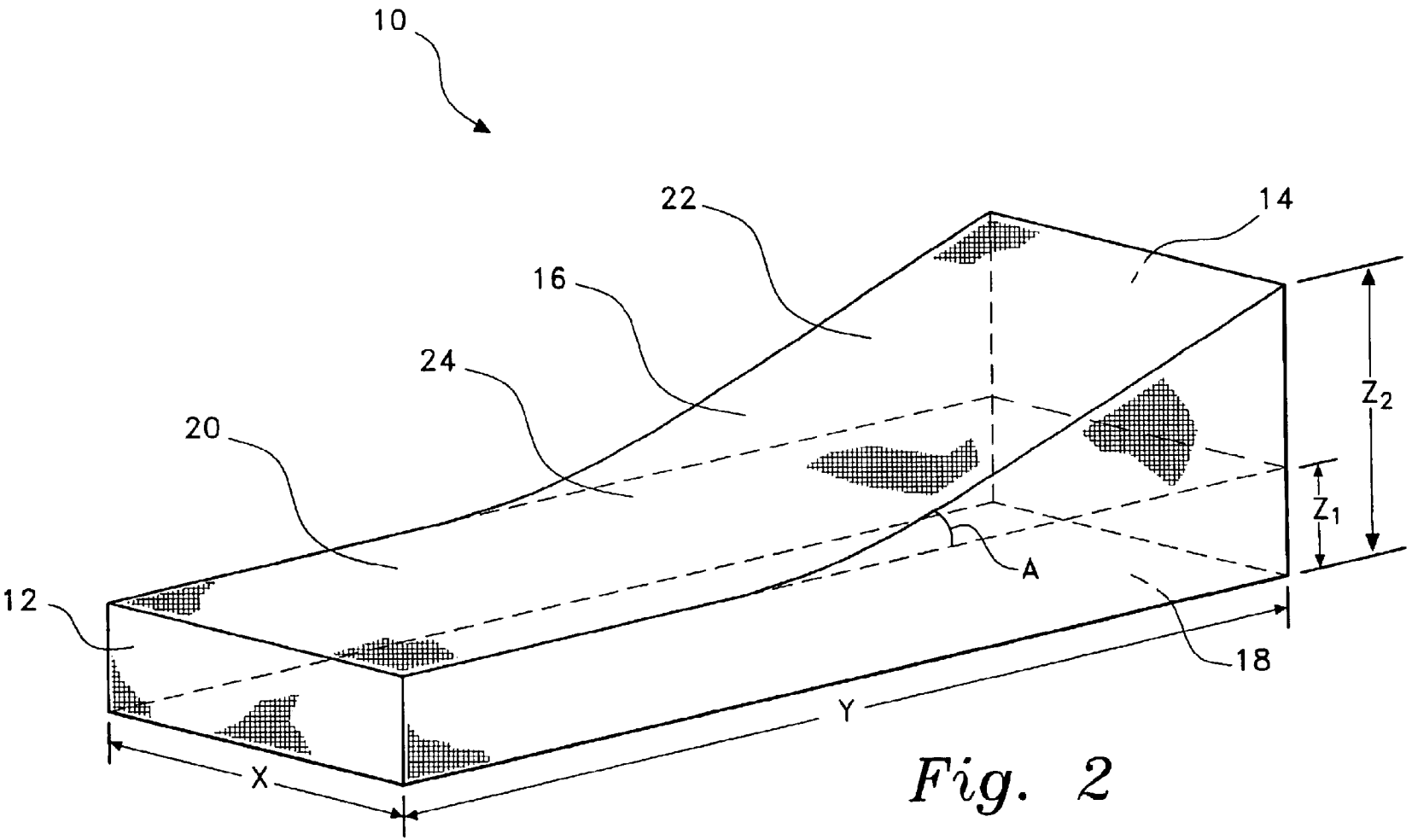
FIG. 2 is a perspective view of an alternative embodiment of a full-body mattress with a flat portion and an inclined portion.

In a sixteenth embodiment, as shown in FIG. 2, the full-body mattress 10 includes all the features of the first embodiment, a first portion 20 of the full-body mattress 10 is not inclined, horizontal, and planar, a second portion 22 of the full-body mattress 10 is inclined at the angle A, and the first portion 20 and the second portion 22 are joined by a transition area 24.

The transition area 24 may be curved (as shown) or may form a crease (not shown). As used in this specification, the curved transition area 24 refers to the gradual sloping of the first portion 20 into the second portion 22; whereas, the crease refers to the intersection of the first portion 20 and the second portion 22 at an angle. The use of the curved transition area 24 is desirable in that it does not limit the sleep position of the user, particularly along the length of the bed in the Y direction. This feature improves the comfort of the user during sleep and helps prevent sleep disorders such as insomnia. Also, the use of a gradual slope makes it easier to fit bedding to the full-body mattress. Although a curved transition area 24 is illustrated, a transition area 24 with a crease may also be provided. The transition area 24 may desirably be provided near the middle of the full-body mattress 10.

Figure 3:
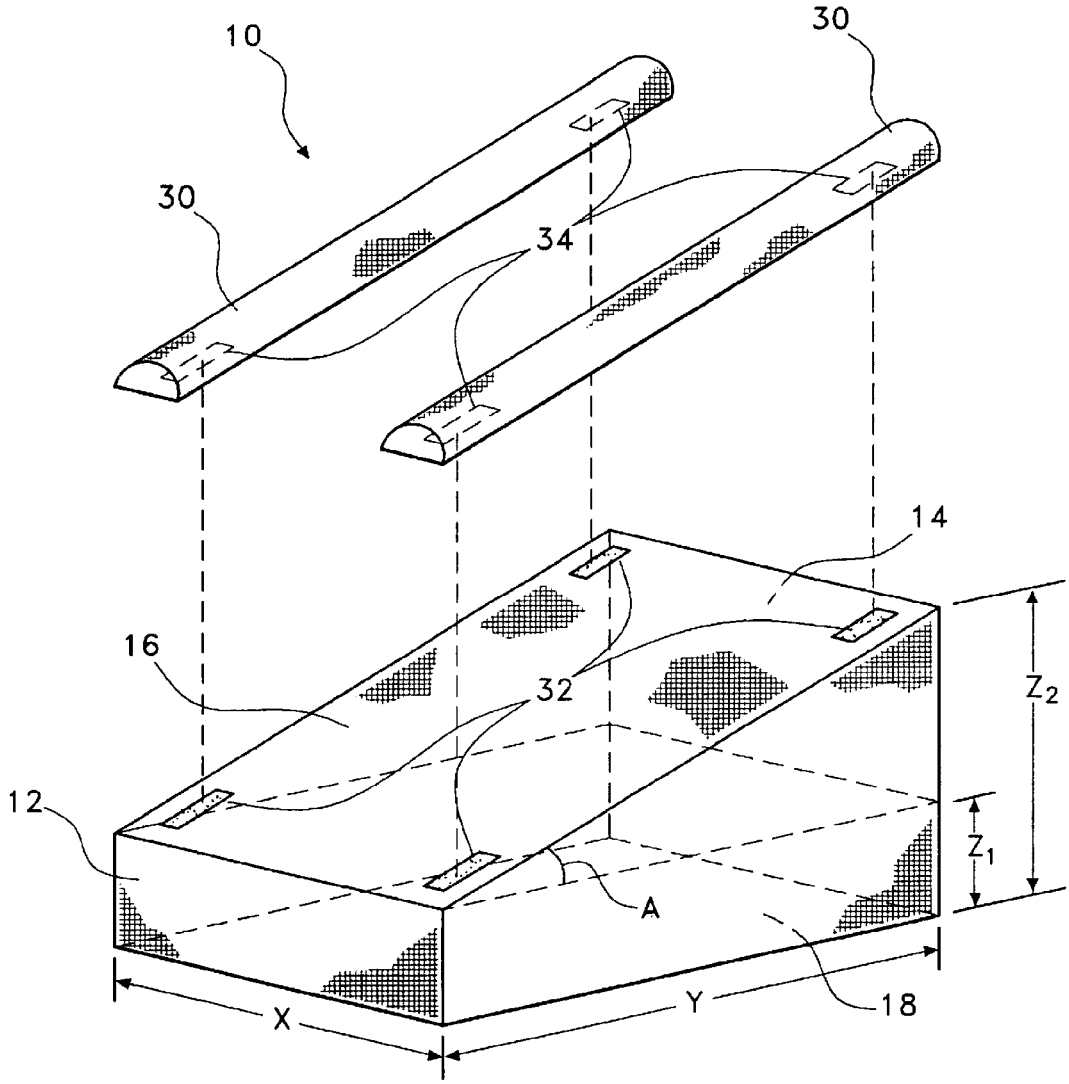
FIG. 3 is a perspective view of the full-body mattress of FIG. 1 with bumpers.

In a seventeenth embodiment, as shown in FIG. 3, the full-body mattress 10 includes all the features of the first embodiment, the full-body mattress 10 further comprises a pair of bumpers 30, the bumpers 30 are disposed in a direction parallel to a length Y of the full-body mattress 10, and the bumpers 30 are disposed on either side of the full-body mattress 10. The bumpers 30 are desirable in that they protect the infant or incapacitated person from rolling off of the full-body mattress 10.

In an eighteenth embodiment, the full-body mattress 10 includes all the features of the seventeenth embodiment, and the bumpers 30 are adapted to be attached and reattached. The bumpers 30 may be removable with any suitable device for attaching and reattaching the bumpers 30 to the full-body mattress 10. For example, strips of a hook and loop fastening material 32, 34 may be used, where the hook material 32 is attached to the top surface 16 of the full-body mattress 10 and the loop material 34 is attached to the bottom surface of the bumpers 30, or vice-versa.

In a nineteenth embodiment, the full-body mattress 10 includes all the features of the first, eleventh and fourteenth embodiments.

Figure 4:
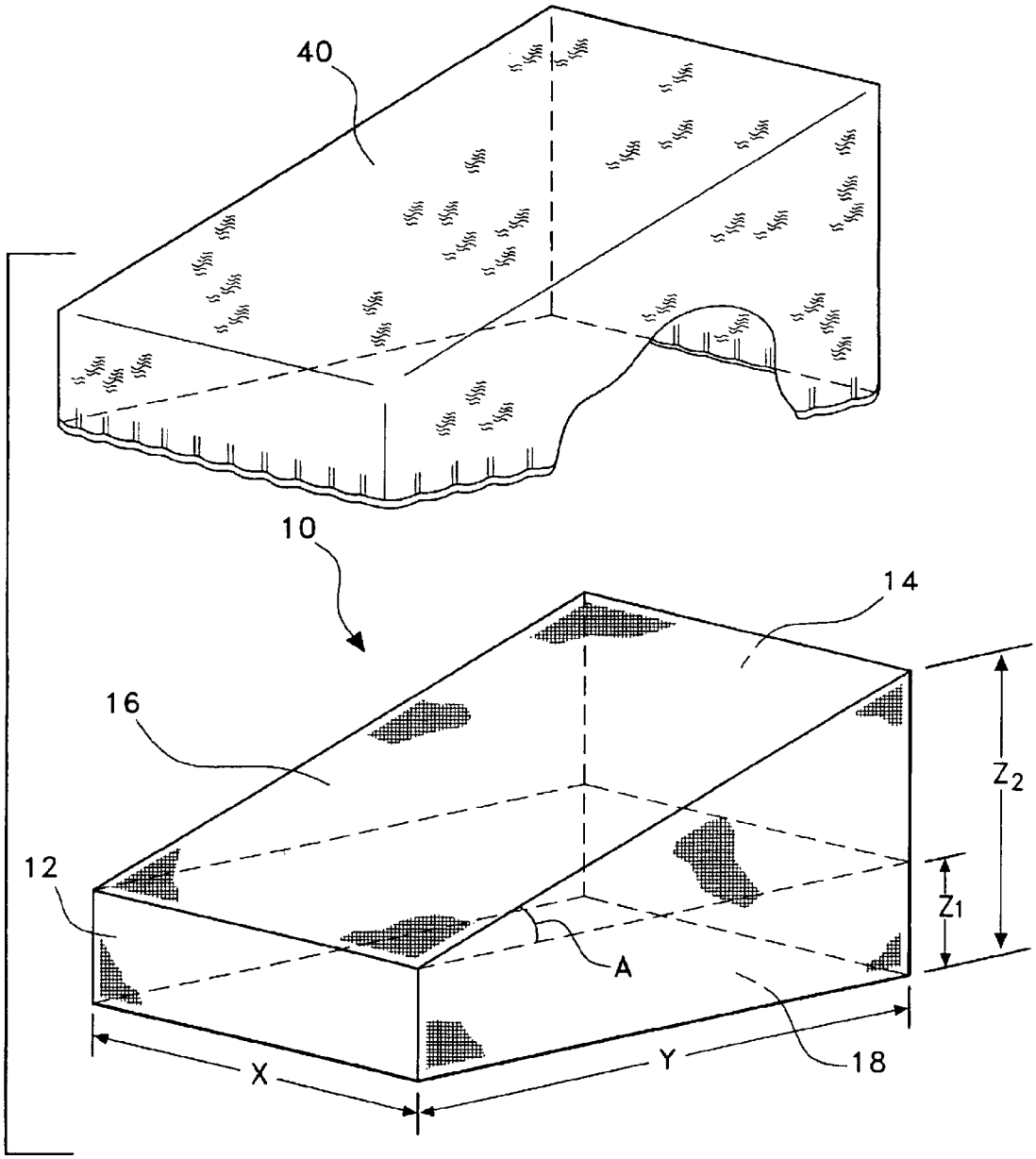
FIG. 4 is a perspective view of a full-body mattress in combination with a full-body mattress covering adapted to fit the full-body mattress, one side being broken away Similar reference characters denote corresponding features consistently throughout the attached drawings.

In a twentieth embodiment, as shown in FIG. 4, the present invention is directed to, in combination, a full-body mattress 10 including all the features of the first embodiment, and a full-body mattress covering 40 adapted to fit the full-body mattress 10. The full-body mattress covering 40 may be any type of covering used to cover the full-body mattress such as, for example, a fitted sheet, a mattress pad, a flat sheet, a comforter, a blanket, and the like. In particular, it is desirable to provide at least the fitted sheet and/or the mattress pad in a size adapted to fit the full-body mattress 10 of the present invention.

It is to be understood that the present invention is not limited to the embodiments described above, but encompasses any and all embodiments within the scope of the following claims.

I claim:

1. An integral, unitary, full-body mattress for the prevention of conditions which may have a negative impact on health and for the improvement of the health and comfort of a user, the full-body mattress comprising:

a first portion of the full-body mattress approximately one-half a length of the mattress, the first portion having a first end defining a first height;

a second portion of the full-body mattress approximately one-half the length of the mattress, the second portion having a second end defining a second height, the second height greater than the first height;

a top surface disposed between the first end and the second end;

a horizontal, planar, bottom surface disposed opposite the top surface; the top surface of the first portion of the mattress parallel to the bottom surface, the top surface of the second portion of the mattress inclined upwardly at an angle of about 30 degrees;

a curved transition area in the top surface, the transition area dividing the first portion from the second portion, the transition area disposed near a middle of the mattress, the curved transition area providing a gradual sloping from the first portion into the second portion of the mattress; and a pair of removably attached bumpers disposed in a direction parallel to the length of the full-body mattress, the bumpers being disposed on either side of the full-body mattress.

* * * * *